US006592442B2

(12) United States Patent
Hoffheimer

(10) Patent No.: US 6,592,442 B2
(45) Date of Patent: Jul. 15, 2003

(54) FLAP WHEEL

(75) Inventor: Craig R. Hoffheimer, Cincinnati, OH (US)

(73) Assignee: Jason Incorporated, Conover, NC (US)

( * ) Notice: Subject to any disclaimer, the term of this patent is extended or adjusted under 35 U.S.C. 154(b) by 106 days.

(21) Appl. No.: 09/753,032

(22) Filed: Jan. 2, 2001

(65) Prior Publication Data

US 2002/0086631 A1 Jul. 4, 2002

(51) Int. Cl.[7] ..... B24B 9/02

(52) U.S. Cl. ..... 451/466; 451/468; 451/469; 248/231.81; 51/332

(58) Field of Search ..... 451/464, 465, 451/466, 468, 469; 51/332–333, 334, 336, 337, 394, 407; 24/DIG. 50; 248/231.81, 316.7

(56) References Cited

U.S. PATENT DOCUMENTS

| | | | | | |
|---|---|---|---|---|---|
| 3,890,746 | A | * | 6/1975 | Saegusa et al. | 451/469 |
| 4,080,714 | A | * | 3/1978 | Emerson | 29/509 |
| 4,872,292 | A | * | 10/1989 | Block | 451/466 |
| 4,882,879 | A | * | 11/1989 | Warner et al. | 451/466 |
| 4,993,198 | A | * | 2/1991 | Hotani | 451/342 |
| 5,396,680 | A | * | 3/1995 | Belanger | 15/230.16 |
| 5,588,172 | A | * | 12/1996 | Biocca | 15/179 |
| 5,707,278 | A | * | 1/1998 | Korn | 300/21 |
| 5,722,881 | A | * | 3/1998 | Emerson | 451/464 |
| 5,903,951 | A | * | 5/1999 | Ionta et al. | 15/180 |

FOREIGN PATENT DOCUMENTS

DE 3920971 A1 1/1990

* cited by examiner

*Primary Examiner*—Joseph J. Hail, III
*Assistant Examiner*—Anthony Ojini
(74) *Attorney, Agent, or Firm*—Renner, Otto, Boisselle & Sklar

(57) ABSTRACT

A flap wheel includes an aluminum hub with outwardly opening peripheral slots. Flap clips also made of aluminum each holding a bundle of flaps fit snugly in the slots. The slots and clips include an elongated socket and knob construction. The socket of the slot and knob of the clip both have an arched or rounded bottom and straight parallel side walls terminating in opposed retaining keys projecting inwardly from the side walls of the slot or corresponding key ways in the clip. The outer ends of the clips include a thin wall U-shape flap bundle retention slot having a flat but skew or slanting bottom wall. The slots extend uniformly in a non-radial direction angled away from the direction of rotation. The flat but skewed bottom of the clips also slants inwardly toward the direction of rotation to position the outer edges of the flaps in the same skewed slanting direction exposing or splaying an outer edge portion of each of the faces or flat surfaces of the flaps to the work as the wheel rotates. The flap bundles may be held in the clips by fasteners or staples extending through the thin walls and the inner ends of the flaps. The entire wheel may be easily refilled, is light weight and may be recycled. The flap arrangement provides additional cut, less flap-to-flap wear, and less noise. The diameter, arbor hole size, and axial length may vary. The hubs may be ganged or stacked to vary the axial length or face width of the wheel. The content of each flap bundle may vary widely, such as any combination of sisal, cloth, abrasive paper, abrasive material or non-woven abrasive and the like.

26 Claims, 3 Drawing Sheets

FLAP WHEEL

DISCLOSURE

This invention relates generally as indicated to a flap wheel and more particularly to a fixed flap wheel which is inexpensive to manufacture, yet easy to operate, which can be recycled environmentally, and yet flexible in width, diameter, or flap type refills.

BACKGROUND

Most flap wheels with insertable flap segments or bundles use flaps secured to the hub with hinges or with a flexible rubber or plastic holder to act as though hinged. This permits the flaps to bend over to an open position as the tool rotates and as the flaps encounter the part. The flaps then curve away from the direction of rotation but tend to spring back from the open position as they clear the part due to centrifugal force. This is in part why they are called flap wheels. The flaps tend to flap about and create excessive noise and wear, the latter due primarily to flap-to-flap wear caused by relative movement of flap against flap.

Also, such hinged flap wheels rely on the arcuate bending of the bundles of flaps to expose the outer edge of the face of the flap to the work. Although the flaps in any bundle are normally the same length, a flap extending around the outside of a curve will have an edge termination before one extending around the inside of the curve, since the distance around the inside is always shorter. For each wheel revolution there is a significant rubbing of flap against flap as the bundles move from the open or bent condition back to the radial position and then back to the open position all within one revolution of the wheel. A hinged flap wheel can literally wear itself out.

The hinge construction adds considerably to the cost of the tool or wheel and limits the recyclability of the tool. It also limits the simplicity of the tool, making it more difficult to change length, diameter, or to change the make-up of the flap bundle.

Accordingly, it would be desirable to have a simple fixed flap wheel where the outer edges of each flap face are exposed to the work without the constant flexing and rubbing. It would also be desirable to have a versatile flap wheel with few simple parts all made of aluminum so they can readily be recycled through aluminum recycle systems.

SUMMARY OF THE INVENTION

A flap wheel includes an anodized aluminum hub with outwardly opening peripheral slots. Flap clips also made of aluminum each holding a bundle of flaps fit snugly in the slots. The slots and clips include an elongated socket and knob construction. The socket of the slot and knob of the clip both have an arched or radius bottom and straight parallel side walls terminating in opposed retaining keys projecting inwardly from the side walls of the slot, or corresponding key ways in the clip. The outer ends of the clips include a thin wall U-shape flap bundle retention slot having a flat but skew or slanting bottom wall. The slots extend uniformaly in a non-radial direction angled away from the direction of rotation. The flat but skewed bottom of the clips also slants inwardly toward the direction of rotation to position or splay the outer edges of the flaps in the same skewed slanting direction exposing at the outer edge portion, each of the faces or flat surfaces of the flaps to the work as the wheel rotates. The flap bundles may be held in the clips by fasteners or staples extending through the thin walls and the inner ends of the flaps. The entire wheel may be refilled quickly, is lightweight and may be recycled. The flap arrangement provides additional cut, less flap-to-flap wear, and less noise. The diameter, arbor hole size, and axial length may vary. The hubs may be ganged or stacked to vary the lengths or face width of the wheel. The content of each flap bundle may vary widely, such as any combination of sizal, cloth, abrasive paper, abrasive belt material, or non-woven abrasive and the like.

DETAILED DESCRIPTION OF THE PREFERRED EMBODIMENTS

Figure 1:
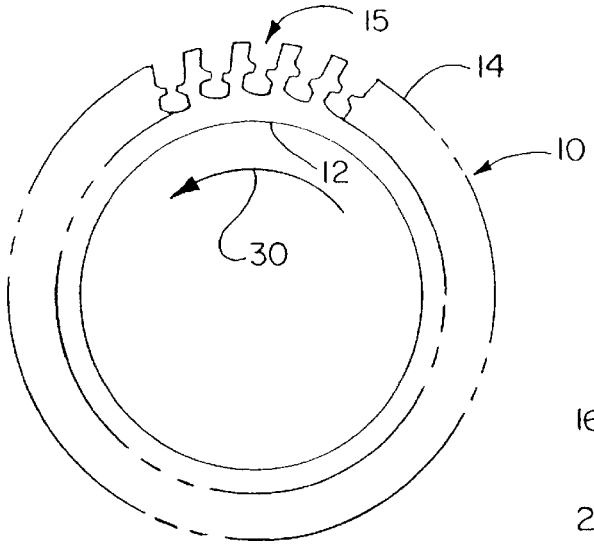
FIG. 1 is an axial end elevation of a flap wheel hub in accordance with the present invention.
Figure 2:
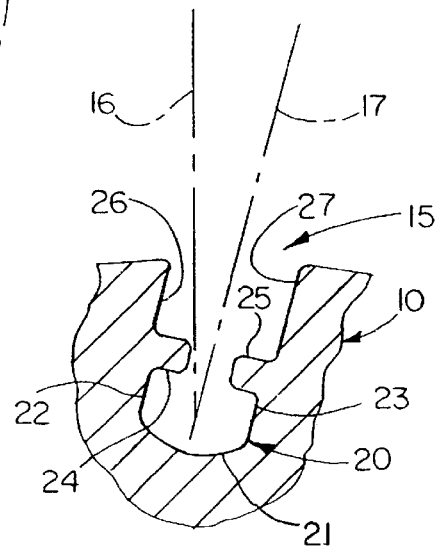
FIG. 2 is an enlarged fragmentary transaxial section showing the detail of one of the peripheral slots.
Figure 4:
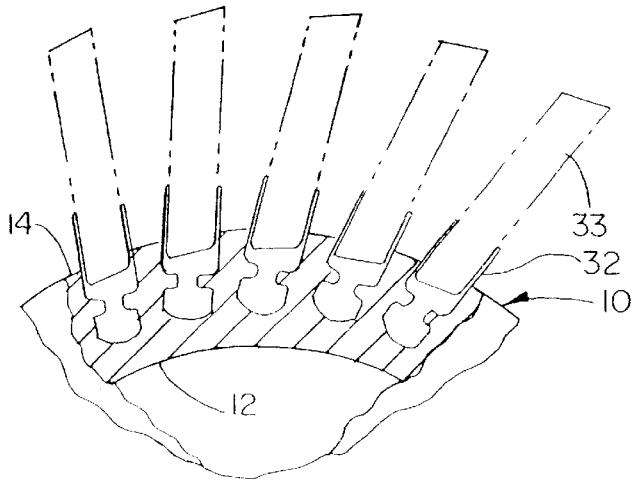
FIG. 4 is an axial end elevation partially in section of an assembled tool.

Referring initially to FIGS. 1, 2 and 4 there is illustrated a hub shown generally 10 of a fixed flap wheel in accordance with the present invention. The hub may be formed by an aluminum extrusion and machined. The hub includes an interior a large circular opening 12 and an exterior circular periphery 14. The periphery of the hub is formed with a plurality of equally spaced slots shown generally at 15 which open to the periphery of the hub and which extend axially of the hub throughout its length. The detail of each slot is shown more clearly in FIG. 2. As indicated, the hub is extruded aluminum and may be hard anodized.

Referring now to FIG. 2, it will be seen that the radius of the hub is shown as 16 while the axis of symmetry of the slot is shown at 17. The angle between the axis of symmetry and the radius of the hub may vary from about 10° to about 20° and is preferably about 15°.

Each slot includes an inner elongated socket shown generally at 20 which has a rounded arched inner wall 21 which blends into parallel sidewalls 22 and 23 forming the socket. The socket terminates in two inwardly projecting keys shown at 24 and 25. Beyond the keys the parallel sidewalls 26 and 27 of the slot are somewhat wider and the wall 26 on the side of the slot in the intended direction of rotation is somewhat shorter than the wall 27. In each of FIGS. 1, 2 and 4, the intended direction of rotation is counter-clockwise or in the direction of the arrow 30 seen in FIG. 1.

Figure 3:
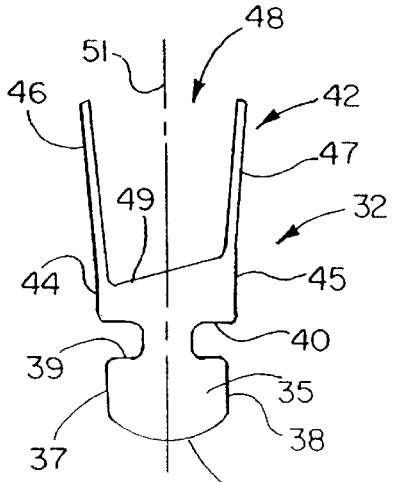
FIG. 3 is an end elevation of the flap bundle clip before insertion of the bundle.
Figure 5:
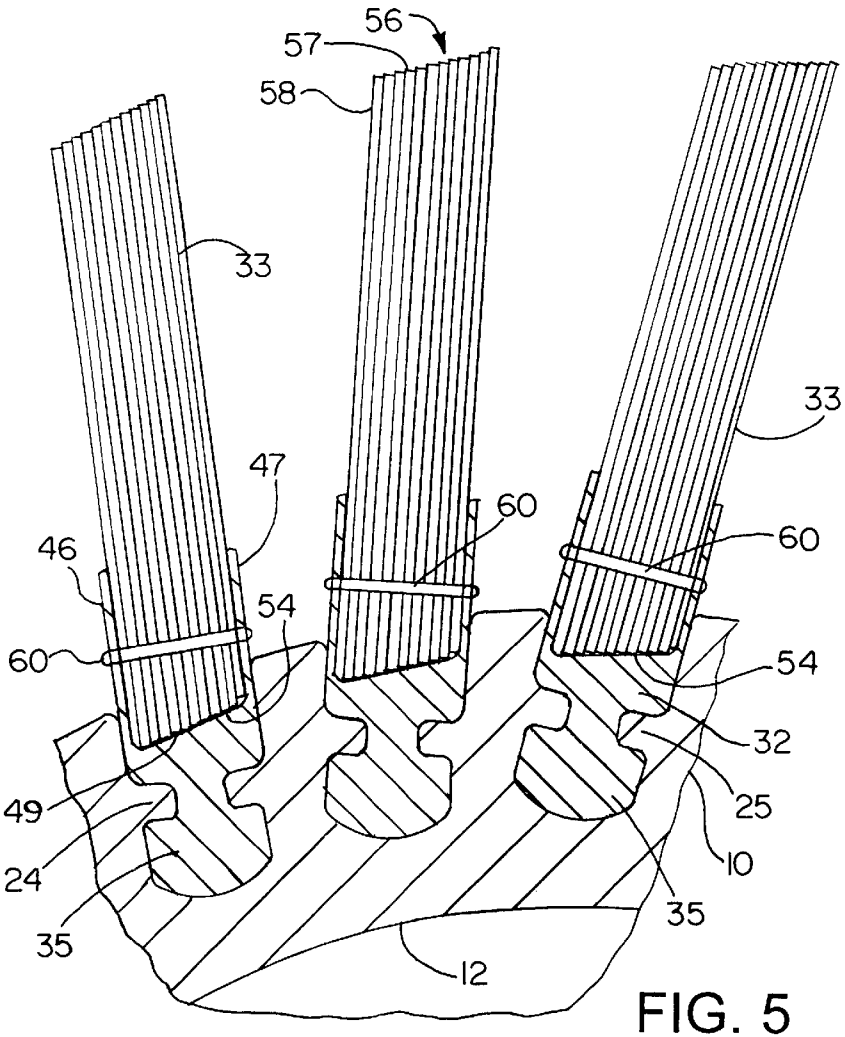
FIG. 5 is an enlarged fragmentary edge section showing in elevation the outer end of several bundles.

Each slot 15 is designed to receive a flap clip shown generally at 32 in FIG. 3. As seen in FIGS. 4 and 5, each flap clip has secured thereto a bundle of projecting flaps seen at 33.

Each flap clip includes an inner elongated knob 35 which includes a cylindrical rounded or arched inner surface 36, parallel side walls 37 and 38 extending from the inner rounded surface to key ways 39 and 40. The knob is designed for a sliding fit with the socket 20 and the key ways 39 and 40 accommodate in a sliding fit the keys 24 and 25.

Beyond the key ways the bundle clip includes a bundle retaining portion shown generally at 42 which includes parallel sidewalls 44 and 45 somewhat wider than the sidewalls of the knob. The sidewalls 44 and 45 extend into slightly flared relatively thin sidewalls 46 and 47 which form a generally U-shaped slot 48 adapted to receive the inner edges of the bundle 33 of flaps. The slot has a planar yet angled or skewed bottom wall 49 which crosses the axis of symmetry of the bundle clip shown generally at 51 at a skewed angle of from about 10° to about 20°, and preferably about 15°. Again, the lower portion of the bottom wall of the slot is in the intended counter-clockwise direction of rotation of the hub. The splayed or angled bottom wall makes the left hand side wall 46 seen in FIG. 3 somewhat longer than the right hand side wall 47. When assembled in the sliding fit with the slot, the axes of symmetry 51 and 17 will be coincident and both at an angle to the radius of the hub.

Referring now to FIG. 5, it will be seen that a bundle 33 has been inserted in each of the bundle clips shown and the inner edge of each flap of the bundle shown at 54 engages the bottom wall 49 of each clip, and with the same size flap automatically arranges the outer edges of each flap in the stair-step fashion shown at 56. This exposes a small portion of the face 58 of each flap to the direction of rotation which again, in FIG. 5 is counter-clockwise. Thus by splaying the bottom wall of each bundle clip, the outer edges of each flap in the bundle will be similarly angled and splayed as illustrated to expose a small portion of the face of the flap to the direction of rotation of the tool.

As illustrated in FIG. 5, the bundles may be secured in the clips by suitable fasteners such as the staples indicated at 60. The staples extend through the relatively thin sidewalls of each clip and the inner end of each flap in the bundle securing the bundle to the retainer clip. More than one staple or fastener may be used depending upon the axial length of the clip and assembled bundle.

The bundle may be formed of a wide variety of types of flaps such as coated abrasives, abrasive paper, abrasive belt material, non-woven abrasives, sisals, abrasive cloth, polishing cloth, or mixtures thereof. With the bundles secured to the clip and inserted in the slot, the bundles are fixed and do not hinge or flap about a hinge axis with respect to the hub thus reducing substantially flap-to-flap wear and noise.

Figure 6:
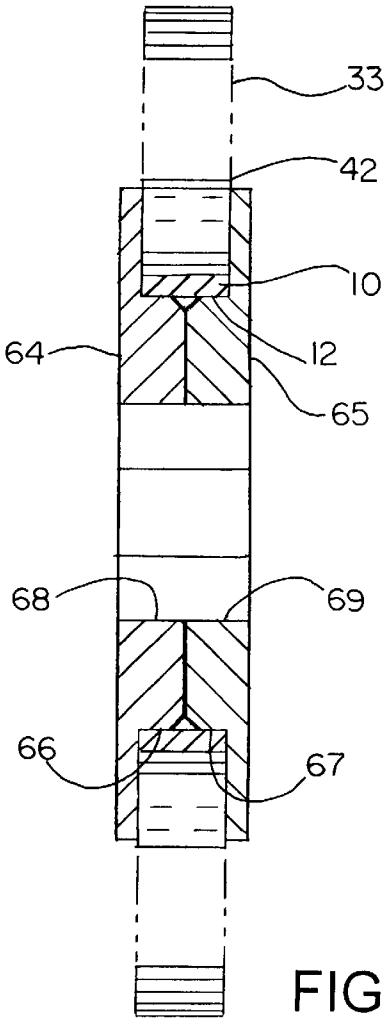
FIG. 6 is a diametral section of one form of assembled wheel.

With reference now to FIG. 6 there is illustrated a relatively short axial length hub indicated at 10 with two side plates 64 and 65 each having chamfered annular shoulders seen at 66 and 67, respectively, fitting within the hub central opening 12. In this manner the side plates may adapt the hub to be mounted with suitable bushes on any size arbor extending through the holes 68 and 69 in the side plates or adapters.

Figure 7:
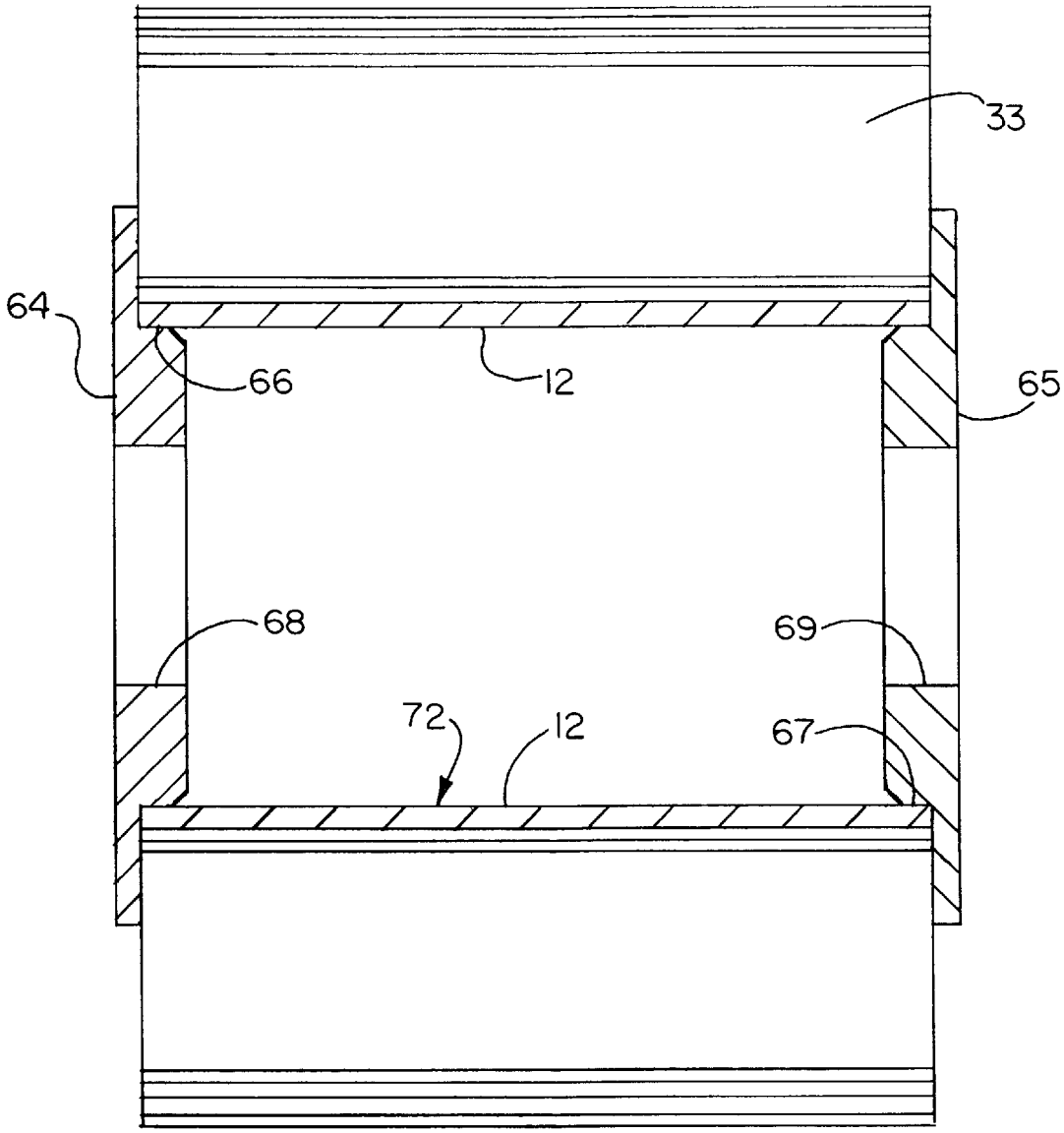
FIG. 7 is a similar section of a wider wheel.

With reference to FIG. 7 the same two side plates or adapters 64 and 65 are shown fitted in the ends of a much longer in axial length hub shown generally at 72 but having the same size internal opening 12. The hub 72 accommodates longer flap bundles 33 and the bundles and bundle clips are of commensurate axial length. In any event, with the adapters or side plates a wider face tool seen in FIG. 7 can readily be mounted on any size arbor.

While the hub is formed of hard anodized aluminum, the clip is simply formed of aluminum and when the tool is worn out the bundles may be replaced or the entire tool may be simply tossed into an aluminum recycling system. The socket and knob, slot and clip system ensures that the bundles will be held firmly in place and yet enables them to be readily slid into the slots endwise for ease in both initial assembly and in refilling the tool if desired.

In any event, it can be seen that the tool of the present invention offers maximum flexibility in defining what goes into each flap refill, being any combination of sisal, cloth, abrasive paper, abrasive belt material or non-woven abrasives. The refill clip is designed to stack the refill sheets to provide the proper position in a fixed or laid-back "open" hub position to provide additional cut, less flap-to-flap wear, and a reduction of movable flap inpingement on the part and reduction of the noise normally associated with conventional hinged wheels.

As can be seen and comparing FIGS. 6 and 7 the hubs may be cut to any length needed and the knob and socket, slot and clip connections support the flaps the entire width of the wheel. The hub clips as well as the end plates or adaptors are all aluminum and can be used once or thrown away as the customer desires. If thrown away, they may be readily recycled.

With aluminum hubs, clips and side plates the weight has been designed out of the system to allow for easy shipping and handling by customers and reduction of freight costs. The hubs may be provided with relatively few arbor sizes that are designed to be bushed down to accommodate any arbor size. The number of slots and the diameter of the hubs as well as the number of packs may vary determined by customer needs.

What is claimed is:

1. A flap wheel comprising a hub, generally radially extending slots in the circumference of said hub, a flap clip inserted in each slot gripping the inner edge of a bundle of flaps, said flap clip having a skew angle sloping bottom wall to arrange the outer edge of each flap in the bundle at an increasing radial extent away from the intended direction of rotation of the wheel to expose a slight extent of the outer edge of each flap face to the direction of rotation of the wheel.

2. A flap wheel as set forth in claim 1 wherein said slots extend at an angle of from about 10° to about 20° to a radius of the hub.

3. A flap wheel as set forth in claim 2 wherein said angle is about 15°.

4. A flap wheel as set forth in claim 1 wherein each slot and flap clip have a generally corresponding center line and said skew angle sloping bottom wall extends across said center line at a skew angle of from about 10° to about 20°.

5. A flap wheel as set forth in claim 4 wherein said skew angle is about 15°.

6. A flap wheel as set forth in claim 1 wherein each slot in said hub includes an inner elongated socket, and each clip includes an elongated knob at its inner end adapted closely to fit in the socket.

7. A flap wheel as set forth in claim 6 wherein said inner socket has a rounded bottom and parallel side walls terminating in inwardly projecting keys.

8. A flap wheel as set forth in claim 7 wherein each slot extends beyond said keys to form parallel side walls opening to the circumference of the hub.

9. A flap wheel as set forth in claim 8 wherein said parallel side walls beyond said keys are somewhat wider than the side walls of the socket.

10. A flap wheel as set forth in claim 7 wherein each knob includes a rounded bottom and parallel side walls terminating in key ways adapted to receive said keys.

11. A flap wheel as set forth in claim 10 wherein said clip extends beyond said key ways to form a U-shape flap bundle retainer with said skew angle sloping bottom wall.

12. A flap wheel as set forth in claim 11 wherein said retainer of said clip includes thin side walls to receive the inner edges of each flap in the bundle, and a fastener extending through said side walls and the bundle beyond the circumference of the hub when the clip is inserted in a slot.

13. A flap wheel comprising a hub, peripheral slots in said hub extending at an angle to a radius of the hub away from the intended direction of rotation, each slot including a restricted elongated socket, a flap clip inserted in each slot having a corresponding elongated knob received in said socket, each slot and clip having a center line, the outer end of said clip being generally U-shaped and having a bottom wall extending at a skew angle to said center line with the lowest radial elevation of said bottom wall being in the intended direction of rotation of the hub.

14. A flap wheel as set forth in claim 13 wherein each center line extends at an angle to a radius of the hub of about 15°.

15. A flap wheel as set forth in claim 13 wherein the skew angle of said bottom wall with respect to said center line is about 15°.

16. A hub for a flap wheel comprising a plurality of peripheral slots opening generally radially and each including an inner elongated socket having a rounded bottom and parallel side walls terminating in inwardly projecting keys, said slot extending beyond the keys to form parallel side walls opening to the circumference of the hub.

17. A hub as set forth in claim 16 wherein said parallel side walls opening to the circumference are somewhat wider than the parallel side walls of the socket.

18. A hub as set forth in claim 17 wherein the side wall opening to the circumference on the side of the slot toward the intended direction of rotation is somewhat shorter than the opposite wall.

19. A hub as set forth in claim 16 including a flap bundle clip inserted in each slot, said clip including an elongated knob closely fitting in said elongated socket and formed by key ways accommodating said keys.

20. A hub and clip combination as set forth in claim 19 including a bundle of flaps in each clip secured to array each flap of the bundle to expose the outer edge of the flap face to the work.

21. A flap bundle clip for a flap wheel comprising an inner elongated knob having a rounded bottom and generally parallel sides terminating in key ways, the clip extending beyond the key ways and forming a U-shape flap bundle retainer having a planar yet slanted bottom wall and relatively thin side walls, the slanted bottom wall engaging the inner edge of each flap in the bundle and arranging each outer edge of each flap in the same slanted array, and a fastener adapted to extend through the relatively thin side walls to secure the bundle in the clip.

22. A flap bundle clip as set forth in claim 21 wherein the side walls of the clip are initially flared to facilitate insertion of the bundle.

23. A rotatable hub for a flap wheel comprising a plurality of equally circumferential spaced axially extending parallel flap bundle receiving slots in the periphery of the hub, each slot inwardly terminating in a socket extending along the bottom of the slot, said socket also being formed by inward projections forming a restricted portion narrowing the slot, and beyond the restricted portion, said slot extending with parallel side walls generally radially to an opening at the periphery of the hub.

24. A hub as set forth in claim 23 wherein one side wall of each parallel side wall is shorter than the opposite side wall.

25. A hub as set forth in claim 23 wherein each slot has a center line, each center line extending at a common angle to a radius of the hub.

26. A hub as set forth in claim 25 wherein said common angle extends opposite the direction of rotation of the hub.

* * * * *